US005606999A

United States Patent [19]

Johansson

[11] Patent Number: 5,606,999

[45] Date of Patent: Mar. 4, 1997

[54] SHUTTLE SPOOL WITH YARN TRAPPING DEVICE

[75] Inventor: Hans Johansson, Örtvägen, Sweden

[73] Assignee: Texo AB, Almhult, Sweden

[21] Appl. No.: 378,751

[22] Filed: Jan. 26, 1995

[30] Foreign Application Priority Data

Jan. 26, 1994 [SE] Sweden ..... 9400223

[51] Int. Cl.[6] ..... D03D 45/00; B65H 69/04

[52] U.S. Cl. ..... 139/257; 139/224 A; 242/18 EW

[58] Field of Search ..... 139/224 A, 257, 139/246, 260; 242/18 EW, 35.6 E, 164, 125.2

[56] References Cited

U.S. PATENT DOCUMENTS

| | | | |
|---|---|---|---|
| 860,703 | 7/1907 | Stone . | |
| 2,000,968 | 5/1935 | Lundgren | 139/246 |
| 2,270,106 | 1/1942 | Boyce | 242/18 EW |
| 3,433,272 | 3/1969 | Nakano . | |
| 3,640,053 | 2/1972 | Hartley, Jr. | 242/18 EW |
| 4,084,767 | 4/1978 | Witt | 242/18 EW X |
| 4,889,294 | 12/1989 | Adams et al. . | |
| 5,016,677 | 5/1991 | Murakami et al. | 139/224 R X |

FOREIGN PATENT DOCUMENTS

| | | | |
|---|---|---|---|
| 424817 | 5/1911 | France | 139/257 |

*Primary Examiner*—Andy Falik

*Attorney, Agent, or Firm*—Law Offices Pollock, Vande Sande & Priddy

[57] ABSTRACT

A shuttle spool and a method for its producing, the spool being for a shuttle in a weaving machine wherein the yarn (thread) is wound onto a pirn which is rotated by rotational devices during the winding. A yarn-trapping device is provided at one end of the pirn, and the pirn with the yarn-trapping device is positioned in the rotational devices. The yarn on the pirn is being wound to form the spool, and after the winding-on of the yarn has been completed, an emerging yarn part is brought into cooperation with the yarn-trapping device for fixing the emerging yarn part.

12 Claims, 6 Drawing Sheets

SHUTTLE SPOOL WITH YARN TRAPPING DEVICE

TECHNICAL FIELD

The present invention relates to a method for producing a spool for a shuttle in a weaving machine where the yarn (thread) is wound onto a pirn which is rotated in a spooling machine, and in which the yarn is wound onto the pirn during production of the spool. The invention also relates to a spool intended for a shuttle and having a yarn-trapping device which is arranged to fix the yarn part or yarn end emerging from the spool. The invention additionally includes a method for spool exchange in a weaving machine where the spool with the yarn-trapping device is utilized and can be applied in a shuttle member, from which a first spool/pirn is removed at the time of exchange in order to be replaced with a new or second spool.

BACKGROUND OF THE INVENTION

Devices for producing spools/shuttle spools for shuttles are already known. In these, the emerging yarn part or yarn end has been secured in a manner in which there has been no clear definition of the position of the yarn end. The yarn end has been secured manually against further turns and/or the yarn pirn has been secured with tape or some similar basic fastening means. For producing spools it is also known to apply and rotate a pirn in a spooling machine which comprises a yarn guide which can be activated in the longitudinal direction of the pirn. Yarn from a yarn magazine is fed onto the pirn via the yarn guide. When the full amount of yarn has been applied to the pirn, the yarn end is cut off and secured in the manner stated above.

In connection with weaving machines, a trend has now emerged for the weaving process to be carried out with as few manpower resources and interventions as possible, which requires, among other things, that the spool exchange in the shuttles be carried out automatically. This means, for example, that the tying together, welding together or equivalent joining of the yarn ends from the empty spool and the new spool would be carried out by mechanical means. It is already known to make arrangements for automatic spool exchange and to utilize, for example, tying and welding apparatuses (ultrasonic welding apparatuses) for joining together the yarn ends in question.

Thus, there is a need for better identification of the yarn ends when handling spools in conjunction with spool production and weaving. The present invention solves this problem, among others, and proposes the use of a yarn-end trapper which is placed on the pirn before the yarn application in the spooling machine. By means of, for example, color markings on or of each yarn trapper, clear identification of the yarn quality, thickness, color etc. can be given.

There is also a need, in the handling of shuttle spools, to allocate the yarn ends clear spatial positions. The invention solves this problem too.

There is a need to be able to rationalize spool manufacture as such in conjunction with the production in a spooling machine. The invention solves this problem.

The use of shuttle spools in the weaving process in weaving machines also in itself presupposes that the shuttle and spool functions can be made more efficient. The invention solves this problem by including a yarn trapper, with the possibility of identification as regards quality, thickness etc., which cooperates in the automated procedure for spool exchange. The yarn trapper allows to control the position of the yarn end, for example in automatic tying and welding functions which are used for joining together the yarn ends on new spools which have been wholly or partly unreeled.

In shuttle spool manufacture it is essential for a clear fastening function to be established and made available for fastening the yarn end. The invention solves this problem too. The fastening according to the invention makes it possible to effectively prevent entangling of yarn when the yarn is being fed onto and from the spool in conjunction with spool manufacture, shuttle spool handling and yarn removal when weaving.

The problem associated with manual taping of the yarn end and with sticky tape residues on the pirn and the weft yarn is also eliminated.

It is also important that the yarn end be fastened and cut off automatically in connection with production in the spooling machine. In this context it is important that there should be no loose final turns on the completed shuttle spool. The invention also solves these problems. In one embodiment the yarn spool can be arranged rotatably on the pirn end, among other reasons in order to eliminate the risks of loose yarn turns occurring.

The manufacture of a yarn trapper clearly functioning on the pirn will also be possible. The invention proposes, in a preferred embodiment, that the yarn trapper be produced in a single piece made of elastic material (for example plastic or aluminium). In one embodiment, it is possible to establish mechanical fastening in an efficient manner. The invention solves this problem. Yarns or threads of a thickness of 0.1 mm or coarser can be fastened in an effective manner. The problem with an improved control of the pirn during the yarn application in the spooling machine is also eliminated by the invention.

In weaving machines it is also important to be able to retain maximum weaving widths despite the introduction of the new facilities.

The characterizing feature of the present method for producing a spool for a shuttle in a weaving machine is, among other things, that before or in conjunction with the positioning of the pirn in the rotational arrangement, for example a spooling machine, a yarn-trapping device is preferably arranged at one end of the pirn, after which the yarn is wound on in order to form the spool. After the winding-on of the yarn has been completed, the emerging part of the yarn is brought into cooperation with the yarn-trapping device for the purpose of fixing the emerging yarn part to the trapper, to facilitate the continued handling of the spool. In conjunction with the fixing, the yarn part is cut off, preferably immediately after the fixing position on the yarn-trapping device.

In a further preferred embodiment it is possible to impart to the yarn-trapping device a rotational movement relative to the pirn in order to create a certain retightening of the final turns of the yarn spool, so that these assume "non-loose" positions or states. The yarn is fastened in the spooling machine or equivalent preferably automatically, so that the end result is a spool with yarn-trapping device which fixes the yarn/the yarn end preferably by mechanical means and at the same time holds the yarn turns taut so that there are no loose yarn turns. The rotation of the yarn-trapping device relative to the pirn can also take place automatically.

In one embodiment the emerging yarn part is laid crosswise on the yarn-trapping device in grooves arranged therein. The groove walls are mutually inclined so that an upwardly/outwardly widening gap is formed. The fastening is in this case carried out in such a way that the yarn is clamped securely and held mechanically against the walls of the groove.

The principal feature of the present invention spool intended for a shuttle and having a yarn-trapping device is that the latter is designed such that it can be applied, preferably at a first end, on a pirn included in the spool, and that the yarn-trapping device, in its position when applied on the pirn, is designed to receive the emerging yarn part when the full amount of yarn has been wound onto the pirn and to fasten this part so that "non-loose" final turns occur on the spool.

In a preferred embodiment, the yarn-trapping device is mounted rotatably on the pirn. The yarn-trapping device is in this way arranged to execute a rotational movement relative to the pirn, which is exploited in order to retighten any loose final turns of the yarn on the spool.

The yarn-trapping device can comprise grooves which are preferably arranged at right angles to each other. A first yarn section can in this case be applied in the first groove, and a second yarn section can be arranged in the second groove, at the same time as a third yarn section connecting the first and second yarn sections runs around a first bearing part extending axially on the yarn-trapping device. The yarn sections cross each other in this way, and the upper (the second) yarn section is pressed down against the first yarn section, which reinforces the fastening function. The first yarn section can be applied in the first groove by means of a gripping member. With this gripping member, the third yarn section can be applied around the axially extending first bearing part, at the same time as the spool and the trapper are rotated about a common longitudinal axis, after which the second yarn section can be applied, likewise with the aid of the gripping member, in the second groove and can be pressed down against the first yarn section, as above.

In one embodiment the yarn-trapping device also comprises an end surface which is arranged on the axially extending second bearing part and which forms a stop surface for the spool turns at the first end of the pirn, as a result of which a well-defined stop is obtained for the yarn on the pirn. The first bearing part and/or the part of the yarn-trapping device having the grooves, or both parts together, can exhibit markings which are associated with the quality, thickness, color etc. of the yarn. Different yarn trappers can also be designed with different colors and shades of the yarn trapper material in order to provide the distinction. The yarn trapper is preferably made of elastic material which can consist of plastic, aluminium, etc.

In one embodiment the yarn-trapping device also entails that the first axially extending part will have bearing members for the rotation in the spooling machine. The grooves on the part exhibiting the grooves merge into widened recesses in order to facilitate the introduction and removal of the yarn in the respective groove.

The method for establishing spool exchange in or on a weaving machine, in which the spool with the yarn-trapping device is used, is principally characterized in that a signal or initiation for the spool exchange is extracted from the weaving machine, its program-controlling unit and/or the shuttle system. Before, during or after the removal of the first spool/pirn from the shuttle member, the emerging yarn part of the first spool/pirn is brought into cooperation with trapping members for yarn parts. A new or second spool with yarn-trapping device is applied in the shuttle member, and gripping members are brought into cooperation with the yarn-trapping device on the new or second spool. The gripping and shuttle members have reciprocal movements, during which the yarn-trapping device is removed from the pirn, and yarn turns are drawn off from the new or second spool. During or after the reciprocal movements, the yarn part drawn off from the new or second spool is brought into cooperation with the trapping members for yarn parts for the purpose of joining the first and second yarn parts by means of known apparatuses, for tying together, welding together etc. the yarn ends.

In one embodiment a spool magazine is arranged on the weaving machine, from which the new or second spool is collected or chosen from a number of spools. The collection and the transfer to the shuttle can be carried out automatically (also in a known manner). The spool stock can be raised and lowered relative to the weave in the weaving machine for the purpose of saving space in the machine and of maintaining maximum/optimal weave widths despite the introduction of the automated tying or welding function.

By means of the present invention, considerable advantages are obtained in terms of efficiency in shuttle spool production and shuttle spool handling in weaving machines. The spool production can be rationalized and made considerably less expensive. The present invention increases the efficiency of the function for joining (tying, welding, gluing, etc.) the yarn ends together. No restrictions need be made on the space in the weaving machine for the weave. The manpower needed for operating the weaving machines can be reduced considerably, and there are fewer interruptions in the running of the machines.

BRIEF DESCRIPTION OF THE DRAWINGS

A presently proposed embodiment of a device having the features significant to the invention will be described hereinbelow, with reference being made at the same time to the attached drawings, in which.

DETAILED DESCRIPTION OF PREFERRED EMBODIMENT(S)

Figure 1:
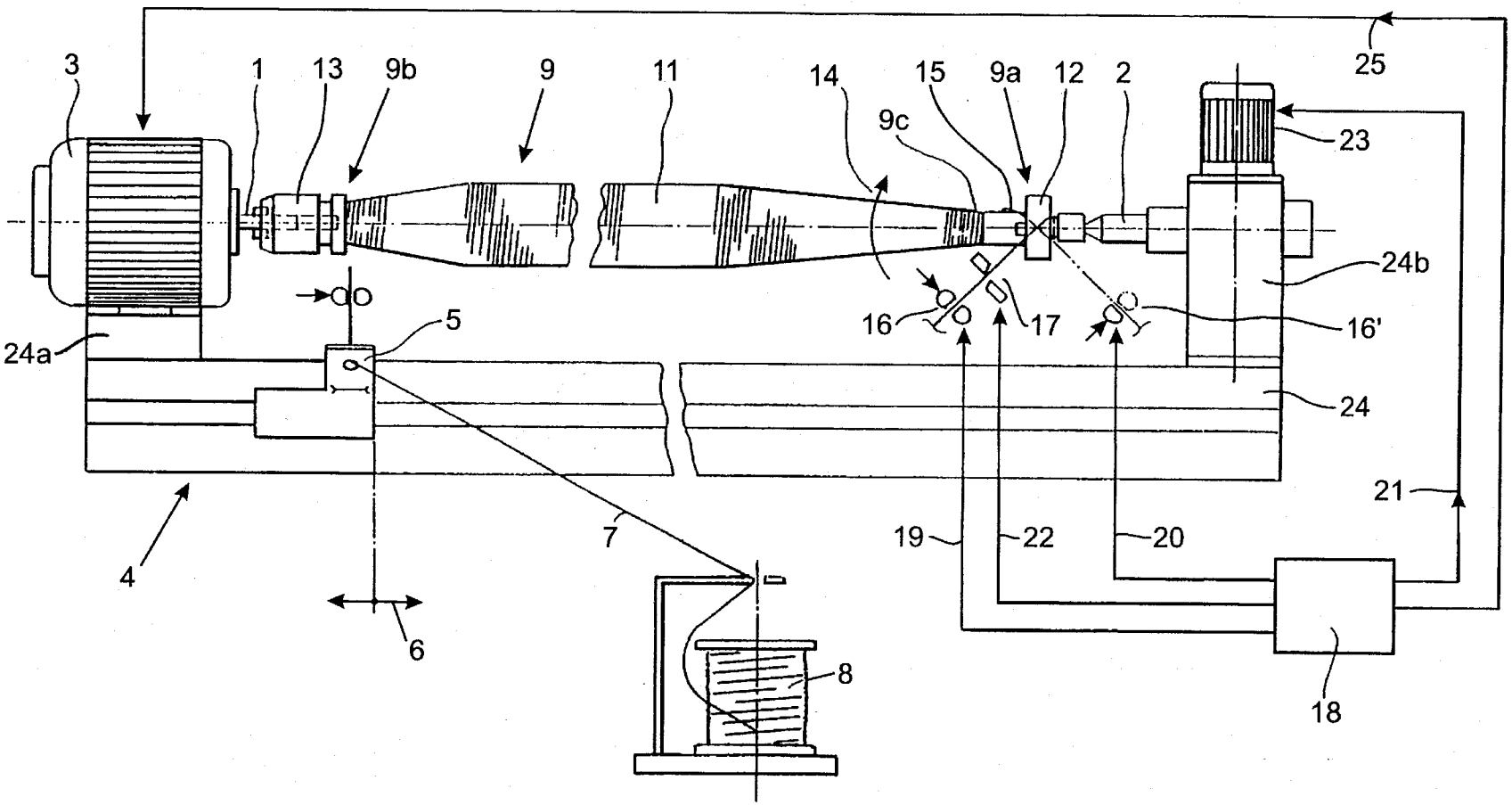
FIG. 1 shows, in a basic outline and from the side, parts of a spooling machine, and, applied therein, a spool with pirn, yarn, and yarn trapper.

In FIG. 1 a spooling machine is represented by its rotating units 1, 2, rotation members (for example an electric motor 3) and yarn guide arrangement 4. The spooling machine is of known type which is described below. A yarn guide 5 is arranged such that it can be displaced in the directions of the arrows 6, and yarn/thread 7 from a yarn stock 8 is guided by the yarn guide 7. A spool 9 is applied in the spooling machine. The spool consists of a pirn, see 10 in FIG. 2, and of yarn 11 wound onto the pirn. During the winding-on, the yarn guide is driven in the longitudinal direction of the spool (directions of the arrows 6). At its first end 9*a*, the spool is provided with a yarn-trapping device 12 and at its other end 9*b* with a bearing member 13. The yarn-trapping device also functions as bearing member, and the pirn and spool are rotatable in at least the direction of the arrow 14 by means of the rotational units 1, 2 which are in engagement with the bearing members. In FIG. 1 the full amount of yarn has been fed onto the pirn, that is, the spool is complete. The emerging yarn part 15 is secured mechanically (or by other means) on or to the yarn-trapping device 12.

In the exemplary embodiment, the emerging yarn part is laid crosswise in grooves which are described in greater detail hereinbelow and is applied around a bearing part on the yarn trapper, which bearing part is likewise described in greater detail hereinbelow. The emerging yarn part is secured on the one hand by means of gripping members which are represented symbolically and which are shown in a first position indicated by 16 and solid lines and in a second position indicated by 16' and broken lines, and on the other hand by means of the spool rotating one or more turns in the spooling machine. A cutting-off function is indicated by 17. The gripping member 16, 16', the rotation (by means of the motor 3), and the cutting function are controlled by a first control unit 18. The control can be effected by electrical and/or mechanical means, and control signals (which can thus be electrical, mechanical, pneumatic etc.) are represented by 19, 20 and 21, 22 and 25. The yarn-trapping device is rotatably arranged on the pirn end in order to ensure that non-loose final turns are present on the spool. The final turns 9*c* are tightened with the aid of a separate motor 23 of adjustable power. The driving motor 3 of the pirn is at this moment or stage locked by a built-in brake. The motors 3 and 23 are arranged on a base 24, 24*a*, 24*b*. The braking function of the motor 3 can be activated and deactivated with a signal or signals 25, and the motor 23 with a signal 21, from the unit 18. The cooperation between the driving motor of the pirn and the driving motor of the yarn-trapping device means that the spool/pirn is prevented from co-rotating and that a relative rotational movement can take place between the yarn-trapping device and the spool/pirn. This relative rotational movement is generally comparatively small. Alternatively, the rotational movement can be carried out manually. The signals 21 and 25 are coordinated for the tightening function.

In accordance with the invention, it will thus be possible for the securing to be effected automatically in the spooling machine, after which the spool, with its secured and well-defined yarn end, can be handled in an advantageous manner upon the spool's continued handling and use in the weaving process.

Figure 2:
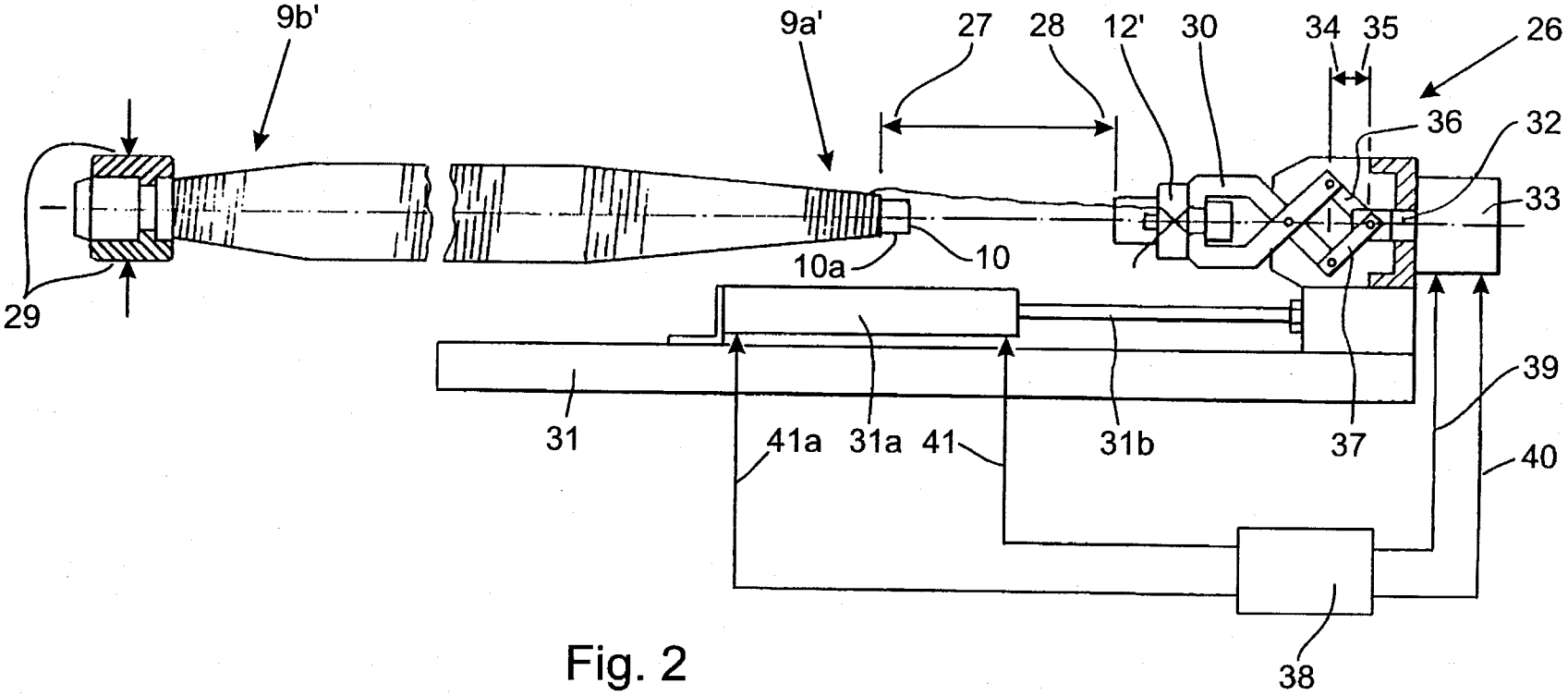
FIG. 2 shows, in a basic outline and from the side, a gripping member, which can cooperate with a yarn trapper, for drawing yarn off from a spool produced in the spooling machine according to FIG. 1.

In accordance with FIG. 2, the yarn end can be collected from the spool end 9*a*' by gripping device 26, which can be of a known type. Using the gripping device, the yarn-trapping device 12' can be drawn off by means of relative movements 27, 28 between spool and gripping device 26, during which yarn turns accompany the gripping device and are drawn off from the spool. In the present case the spool is secured at its end 9*b*' by a securing member 29. The gripping device 26 can operate with a cutting function 30 which cooperates with a peripheral surface on the yarn-trapping device 12'. The gripping member is arranged in such a way that it can be displaced in guide tracks 31 by means of a cylinder and rod 31*a*, 31*b* which are acted on mechanically or electrically (pneumatically). The gripping (cutting) is activated and triggered by means of a rod 32 which can be acted on electrically or mechanically by an activating member 33. The activation directions are shown by 34, 35, and the activation link and the cutting function are shown by 36, 37. The movements are controlled by a control unit 38 which outputs control signals (electrical, mechanical etc.) 39, 40, 41 and 41*a*.

Figure 3:
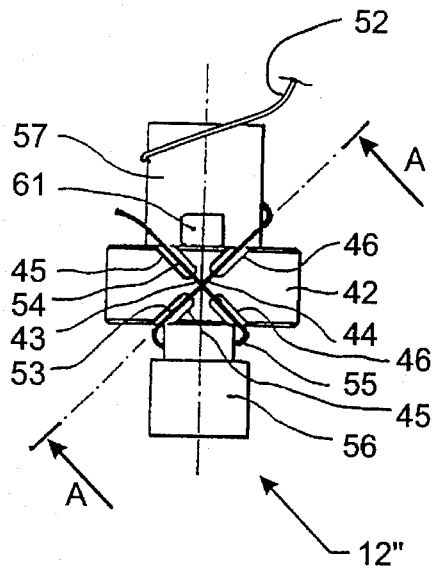
FIGS. 3–3*d* show, in different views and sections, a constructional embodiment of a yarn trapper.
Figure 3A:
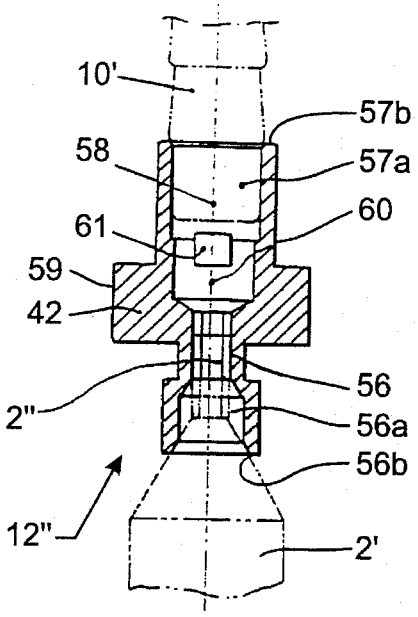
Figure 3B:
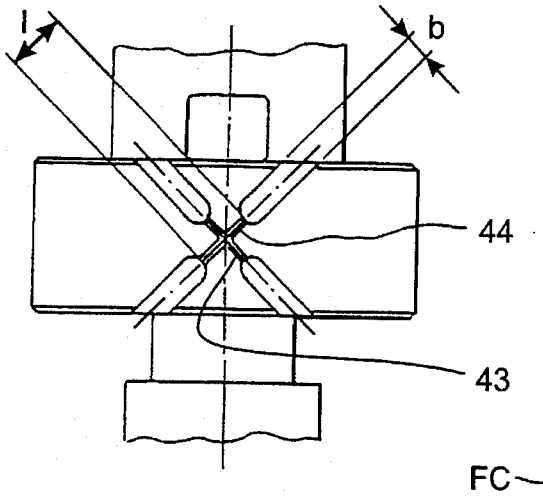
Figure 3C:
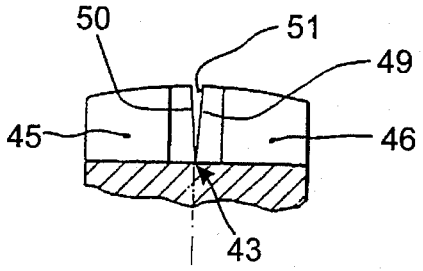
Figure 3D:
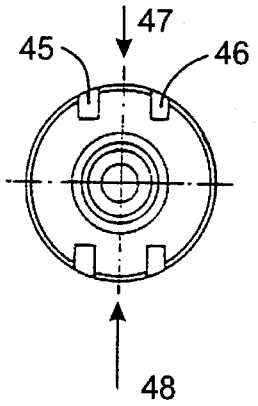

FIGS. 3–3*d* show the yarn-trapping device 12" in detail. The yarn-trapping device is constructed in one piece and is made of elastic material, as described above. The yarn-trapping device has a part 42 which is provided with intersecting grooves 43, 44 which are designed with widening parts 45, 46 at their ends. The grooves and the widening parts are in principle paired, with the groove arrangements placed on diametrally opposite parts 47 and 48 of the periphery of the yarn trapper. In the exemplary embodiment, the grooves have a length l of approximately 4 mm, and the widened parts a width b of approximately 2 mm. The groove walls 49, 50 in each groove are inclined with respect to each other and form a gap 51 which widens from the inside outwards. In the exemplary embodiment, each groove can receive yarn or thread thicknesses of approximately 0.1 mm or larger. Each yarn part is secured by means of friction between the yarn and the groove walls 49, 50.

In FIG. 3, the yarn part emerging from the spool is indicated by 52. A first yarn section 53 is placed in the groove 44, and a second yarn section 54 is placed in the groove 43. A third yarn section 55, which connects the yarn sections 53, 54, is applied around a bearing part 56 which is located on the yarn-trapping device, and the second yarn section 54 crosses the first yarn section 53 and is pressed down against the latter to secure the yarn parts firmly. The yarn-trapping device has also a second bearing part 57. The bearing part 56 is provided with a space 56*a* for the rotational unit 2' (see above). The rotational unit comprises or cooperates with a drive part 2" for separate driving, relative to the pirn, of the yarn trapper 12 according to FIG. 1 by the motor 23 (the motor 3 is braked and forms a counterstay member). The drive part can have a polygonal cross-section, 4-sided or 6-sided cross-section, and cooperates with a recess 56' of a corresponding shape in the yarn trapper. The bearing part 57 has a bearing space 57*a* for the pirn end 10'.

The yarn-trapping device is rotationally symmetrical, with a common axis 58 for the parts 42, 56 and 57. The end surfaces of the parts 56 and 57 are indicated by 56*b* and 57*b*, respectively, which serves as a stop surface for the yarn on the spool.

The yarn-trapping device has a peripheral surface 59 on the part 42, via which the yarn-trapping device can cooperate with gripping device, locking member and the like as described above. The recesses 56*a* and 57*a* are connected by means of an inner channel 60. The yarn-trapping device will be able to function, among others, on spools which comprise pirns of approximately 15 mm diameter and 400 mm length (different dimensions are possible, however). The completed spool can have a diameter of approximately 50 mm. In the exemplary embodiment, the yarn-trapping device can have a total length of approximately 50 mm. The external diameter of the part 42 can be approximately 30 mm. The corresponding external diameters of the parts 56 and 57 are approximately 20 mm and 15 mm, respectively.

The part 57 is formed with a continuous recess 61 which is used for positioning the locking groove arrangements 43, 44 in the spooling machine. The position indication can be effected by photocell (see FC in FIG. 3*d*) in a known manner. The yarn trapper itself can also be colored and thereby constitutes a marking or indication in relation to other yarn trappers of another color. Similarly, the external shapes of the yarn trapper can be modified, and different external shapes constitute different markings, etc. In one embodiment, the material of the yarn trapper can be shaded in a number of different colors and thereby constitutes a marking or indication of the yarn which has been spooled onto the pirn.

Figure 4:
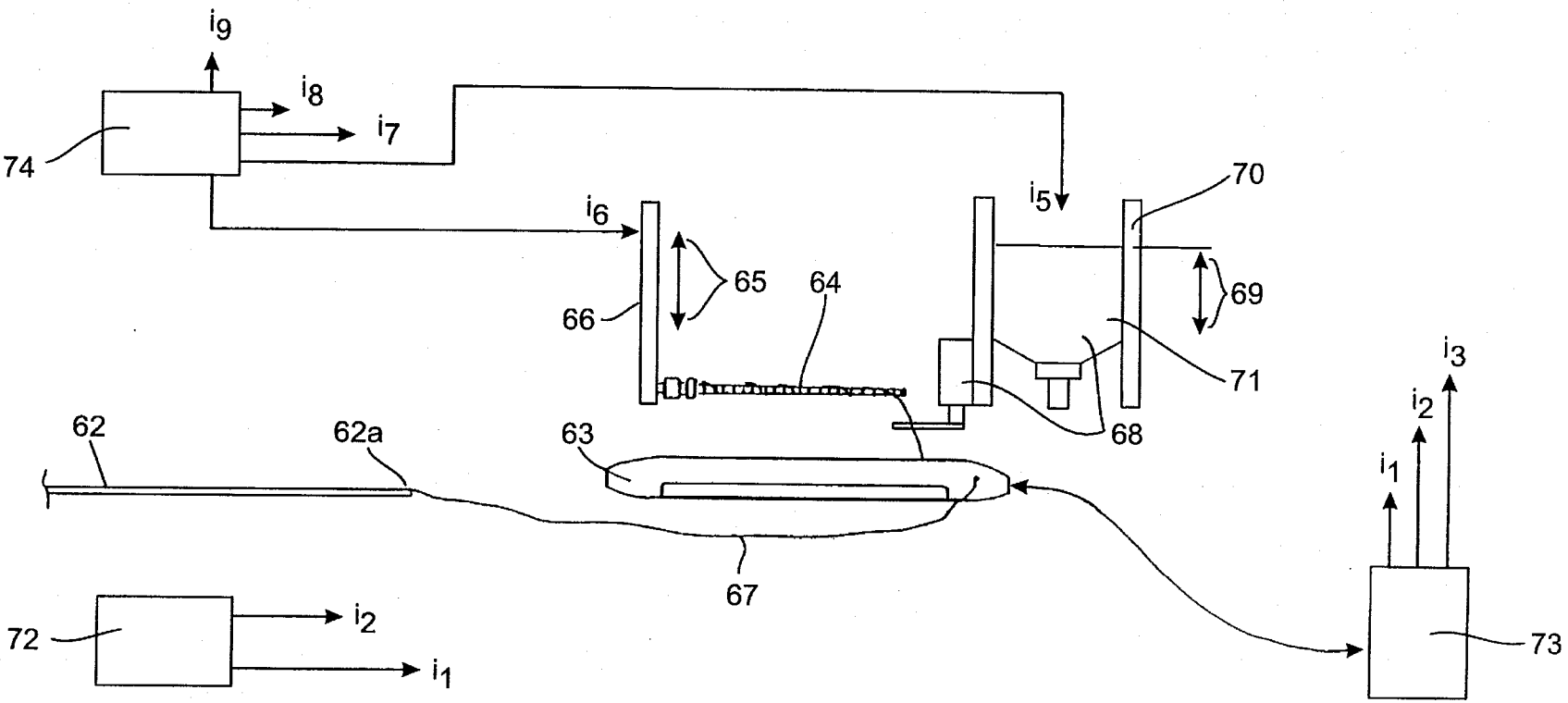
FIGS. 4–4*b* show, in a basic outline and function sequence, a mechanized/automated spool exchange arrangement in a weaving machine.
Figure 4A:
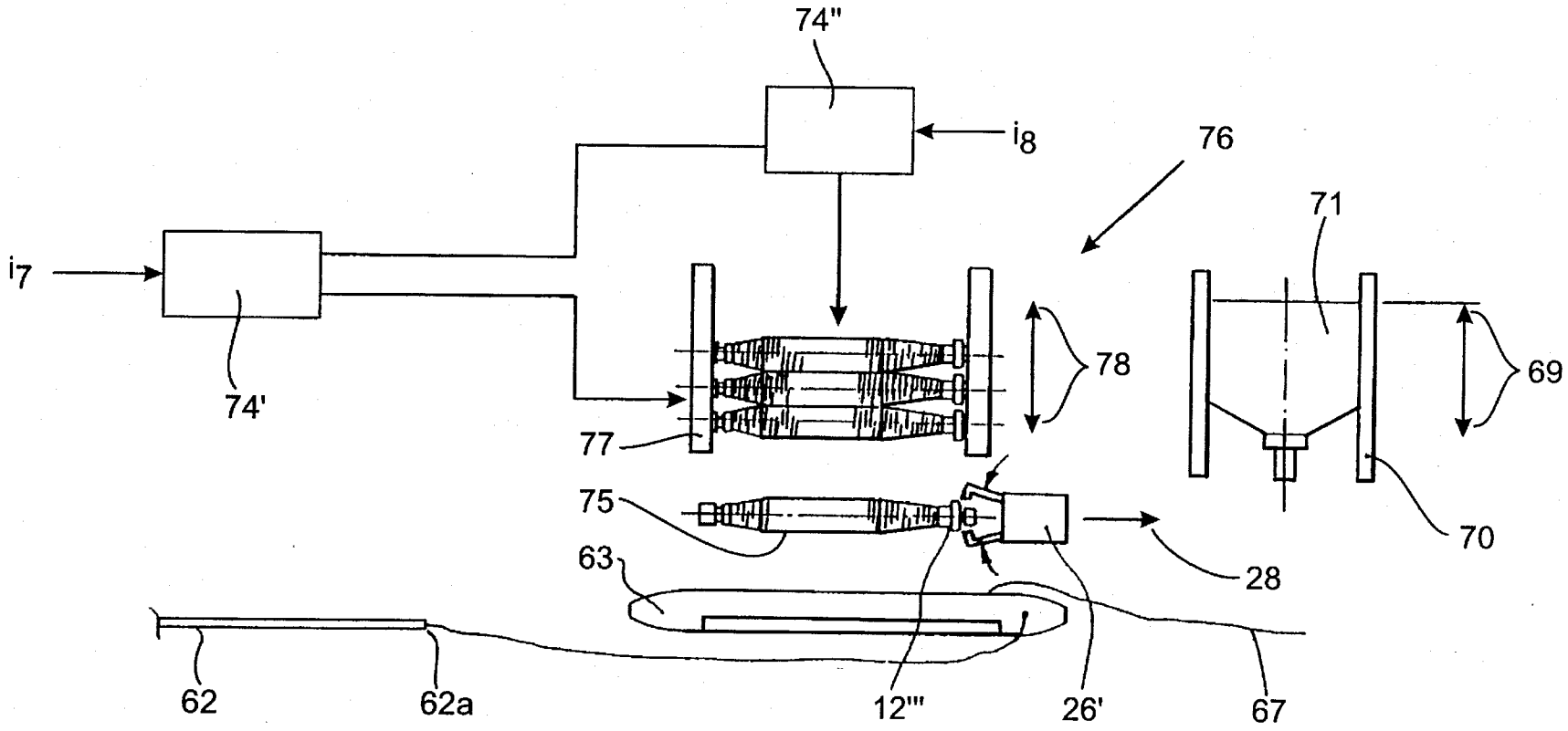
Figure 4B:
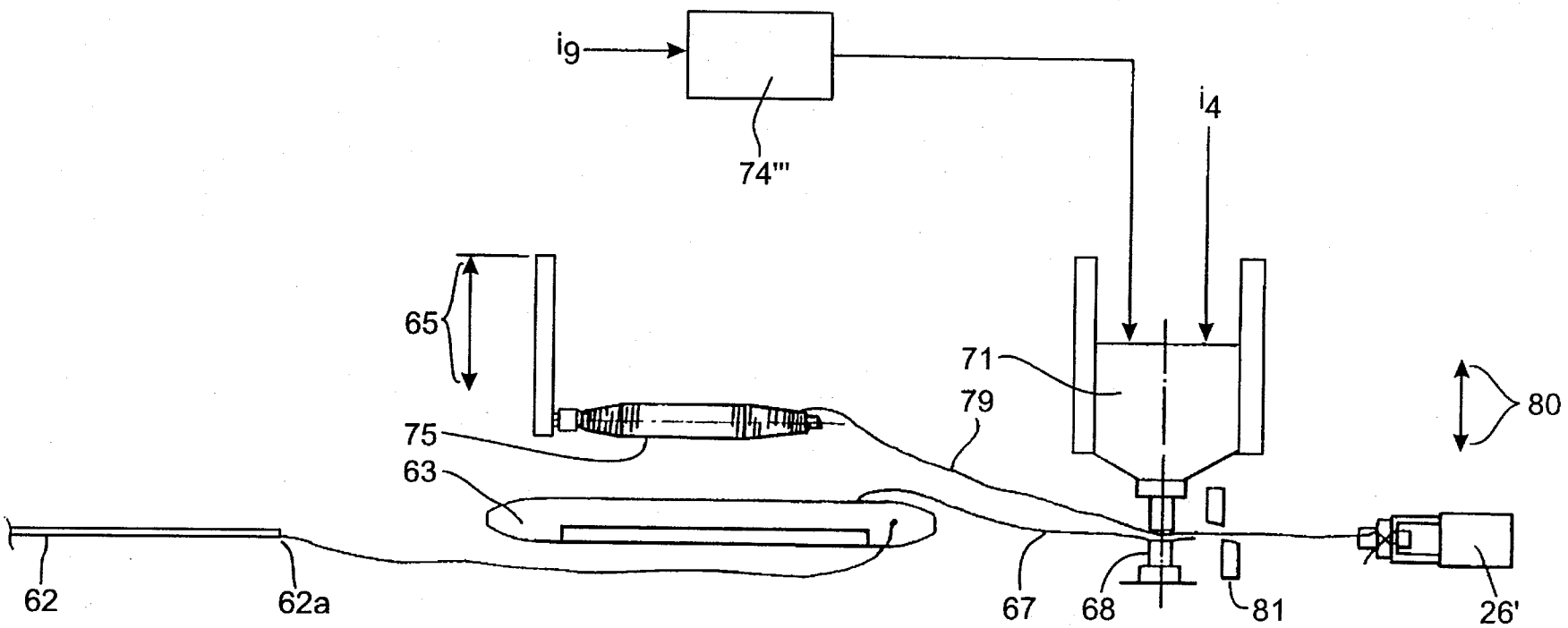

In FIGS. 4–4*b* a woven fabric in a weaving machine is symbolized by 62. An arrangement for automatic spool exchange is also shown in the figures. A shuttle is indicated by 63 and forms part of a known shuttle system for weaving machines. In the present case, the invention is used on weaving machines for cloth which is woven in great widths and lengths (for example, 2×30 meters). A spool in the process of being exchanged is shown by 64. The spool is removed from the shuttle 63 in the direction of the arrow 65 by means of a lifting member 66 of a known type. The yarn (thread) from the fabric edge 62*a* to the spool 64 is shown by 67. The yarn in question will be caught by a yarn picker part 68 which is arranged such that it can move at least vertically in the directions of the arrows 69, for example in a guide track arrangement 70. The yarn picker part comprises an apparatus for joining the yarn ends together. The joining apparatus can be of a known type and is formed by a known tying or welding apparatus (ultrasonic welding apparatus) for yarn ends.

The initiation for spool exchange is obtained from the program unit 72 of the weaving machine, which outputs a signal $i_1$ (electrical signal). In addition to this, or alternatively, the initiation can be obtained from a weaving machine which is symbolized by the signal $i_2$. In addition to this, or alternatively, the initiation can be obtained from a unit 73 which forms part of the shuttle system and which outputs a signal $i_3$. One, two or all of these signals activate a unit 74 which forms part of the system and which controls the lifting member 66 and the yarn picker member 68.

According to FIGS. 4*a* and 4*b*, the removed spool 64 is replaced with a new spool 75, which is provided with the yarn-trapping device 12''' as above. The new spool is collected from a spool stock 76, which can include a number of spools of the same or different yarn qualities, thicknesses, colors etc. A selection mechanism, which operates as a function of the initiation signals $i_1$, $i_2$ and/or $i_3$, selects the correct new spool 75. The selection mechanism is symbolized by units 74' and 74''. The spools in the spool stock (which is shown with three spools in place and with one spool being removed) are controlled by a control member 77. The spool stock can be arranged such that it can be moved at least vertically, see arrows 78. The gripping device 26' comes into cooperation with the yarn-trapping device in order to remove the latter from the spool. The direction of withdrawal is shown by 28.

The gripping device 26' draws the yarn-trapping device and the entrained yarn part 79 past the yarn picker 68, see FIG. 4*b*. The gripping device 26' can also be acted on in the vertical direction 80 in order to escape from the weave edge 62*a*. The yarn parts 67 and 79 are brought together in this way in the yarn picker 68. The system acts, via a unit 74''', on the joining apparatus 71 by means of a signal $i_4$. The signals $i_5$, $i_6$, $i_7$, $i_8$ and $i_9$ from the unit 74 to the members and the units 66, 68, 74', 74'', 74''' are indicated in FIGS. 4–4*b*. After joining, the yarn 79 is cut off with the cutter 81. The vertical movements of the units involved mean that maximum space can be achieved for the weave (position of the edge 62*a*).

The invention is not limited to the embodiment shown above by way of example, but can instead be modified within the scope of the attached patent claims and the inventive concept.

I claim:

1. A method for producing a spool for a shuttle in a weaving machine wherein a yarn (thread) is wound onto a pirn which is rotated by rotational means during the winding, said method comprising the steps of:

a) providing a yarn-trapping device at one end of the pirn;

b) positioning the pirn with the yarn-trapping device in the rotational means;

c) winding the yarn on the pirn to form the spool; and d) after the winding-on of the yarn has been completed, bringing an emerging yarn part into cooperation with the yarn-trapping device for fixing said emerging yarn part, said bringing including positioning said emerging yarn part crosswise in at least a first and a second groove provided on the yarn-trapping device, and bringing the yarn in each groove in a fastening cooperation with walls of said groove forming an upwardly and outwardly widening gap.

2. A method according to claim 1, further comprising the steps of imparting to the yarn-trapping device a rotational movement relative to the pirn for retightening of final turns of the yarn on the spool, and cutting off said emerging yarn part.

3. A method according to claim 2, further comprising effecting said cutting off at a point at said yarn immediately after the yarn-trapping device.

4. A method according to claim 1, further including applying a first yarn section in said first groove by means of a gripping member, then applying a third yarn section, connecting said first and a second yarn section around a first bearing part which extends axially on the yarn-trapping device while simultaneously rotating the spool one or more turns, and thereafter applying said second yarn section in said second groove.

5. A spool arrangement for a shuttle in a weaving machine including a spool provided with a yarn-trapping device, the yarn-trapping device being rotationally mounted on a pirn of said spool before winding of yarn on said spool, means for bringing an emerging part of yarn into cooperation with the yarn-trapping device for fixing said emerging part and means for rotating the yarn-trapping device relative to the pirn, after the full amount of yarn has been applied on the pirn, to retighten any loose final turns of the yarn said yarn-trapping device further comprising bearing members for said rotational means and at least two grooves extending crosswise with respect to each other, wherein each groove is arranged to cooperate mechanically with the respective yarn section via its walls, which form an upwardly and outwardly widening gap, and wherein each groove at both its ends is provided with recesses which facilitate the introduction and removal of the yarn in the groove.

6. A spool arrangement according to claim 5, wherein said at least two grooves of the yarn-trapping device include a first and a second groove which are arranged substantially at right angles with respect to each other, said first groove receiving therein a first yarn section, and said second groove receiving a second yarn section to be pressed down against the first yarn section, and wherein said yarn-trapping device further includes a first bearing part extending axially on the yarn-trapping device, for applying therearound a third yarn section connecting said first and second yarn sections.

7. A spool arrangement according to claim 6, further comprising an axially extending second bearing part which has an end surface which forms a stop surface for the spool turns at one end of the pirn, and wherein said first bearing part is provided with an indication means for indicating one of the rotational position of the yarn-trapping device relative to the pirn, the yarn color, yarn quality and yarn thickness.

8. A method for spool exchange in a weaving machine, in which a spool with the yarn-trapping device is applied in a shuttle of the weaving machine and from which a first spool/pirn is removed at the time of the exchange, said method including the steps of:

1) providing an exchange initiation signal from at least one of a programmable-controlling unit and a shuttle system of the weaving machine;

2) fixing an emerging first yarn part, in trapping members of the yarn-trapping device before, during or after the removal of the first spool/pirn from said shuttle;

3) applying a new, second spool provided with yarn-trapping device in said shuttle;

4) removing the yarn-trapping device from the second spool pirn by gripping members;

5) applying reciprocal movements to the gripping members and shuttle members during which yarn turns are drawn off from the second spool; and wherein during or after the reciprocal movements, the yarn drawn out from the second spool, defining a second yarn part, is received by said trapping members for the purpose of joining the first and second yarn parts.

9. A method according to claim 8, further comprising the steps of collecting the second spool from a spool stock with identical or different composition, and raising or lowering said spool stock relative to the plane/planes of the yarn in the weaving machine.

10. A spool for a shuttle in a weaving machine, said spool being provided with a yarn-trapping device, the yarn-trapping device being rotationally mounted on a pirn of said spool before winding of yarn on said spool and means for bringing an emerging part of yarn into cooperation with the yarn-trapping device for fixing said emerging part, after the full amount of yarn has been applied on the pirn, said means comprising at least two grooves extending crosswise with respect to each other on said yarn-trapping device, wherein each groove is arranged to cooperate mechanically with the respective yarn section via its walls, which form an upwardly and outwardly widening gap, and wherein each groove at both its ends is provided with recesses which facilitate the introduction and removal of the yarn in the groove.

11. A spool according to claim 10, wherein said at least two grooves of the yarn-trapping device include a first and a second groove which are arranged substantially at right angles with respect to each other, said first groove receiving therein a first yarn section, and said second groove receiving a second yarn section to be pressed down against the first yarn section, and wherein said yarn-trapping device further includes a first bearing part extending axially on the yarn-trapping device, for applying therearound a third yarn section connecting said first and second yarn sections.

12. A spool arrangement according to claim 10, further comprising an axially extending second bearing part which has an end surface which forms a stop surface for the spool turns at one end of the pirn, and wherein said first bearing part is provided with an indication means for indicating one of the rotational position of the yarn-trapping device relative to the pirn, the yarn color, yarn quality and yarn thickness.

* * * * *